US009857719B2

(12) United States Patent
Mimura

(10) Patent No.: US 9,857,719 B2
(45) Date of Patent: Jan. 2, 2018

(54) IMAGE FORMING APPARATUS HAVING PHOTOSENSITIVE BODY AND CHARGING DEVICE

(71) Applicant: Brother Kogyo Kabushiki Kaisha, Nagoya-shi, Aichi-ken (JP)

(72) Inventor: Chieko Mimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/059,374

(22) Filed: Mar. 3, 2016

(65) Prior Publication Data

US 2016/0259283 A1 Sep. 8, 2016

(30) Foreign Application Priority Data

Mar. 6, 2015 (JP) ..... 2015-044198

(51) Int. Cl.
*G03G 15/02* (2006.01)
*G03G 15/00* (2006.01)

(52) U.S. Cl.
CPC ..... *G03G 15/0266* (2013.01); *G03G 15/0291* (2013.01); *G03G 15/5037* (2013.01); *G03G 2215/0141* (2013.01); *G03G 2215/027* (2013.01)

(58) Field of Classification Search
CPC ..... G03G 15/0266; G03G 15/0291; G03G 15/50; G03G 15/5033; G03G 15/5037; G03G 15/5029; G03G 2215/026; G03G 2215/027; G03G 2215/028
See application file for complete search history.

(56) References Cited

U.S. PATENT DOCUMENTS 5,057,867 A * 10/1991 Ishigaki ..... G03G 15/5025 399/43
6,205,298 B1 * 3/2001 Yamamoto ..... G03G 15/0266 399/25
7,831,162 B2 * 11/2010 Yamane ..... G03G 15/0266 399/50
2007/0086801 A1 * 4/2007 Sakato ..... G03G 15/5037 399/50

(Continued)

FOREIGN PATENT DOCUMENTS

JP H02-87176 A 3/1990

*Primary Examiner* — David M Gray
*Assistant Examiner* — Carla Therrien
(74) *Attorney, Agent, or Firm* — Banner & Witcoff, Ltd.

(57) ABSTRACT

An image forming apparatus includes an image forming portion configured to form a toner image. The image forming portion includes: a photosensitive body; a charging device; an exposure device; a toner supply device; and a transfer device. A continuously printed amount, which has been attained by the image forming portion while the image forming portion has formed toner images continuously with a time interval between every two successive image-forming timings having a length shorter than or equal to a prescribed length, is determined. A charging voltage to be applied to the charging device is set based on a sum of a reference charging voltage and a correction value, the reference charging voltage being determined based on a target surface potential of the photosensitive body, the correction value being determined based on the continuously printed amount.

14 Claims, 8 Drawing Sheets

(56) References Cited

U.S. PATENT DOCUMENTS

| | | | | |
|---|---|---|---|---|
| 2008/0298826 | A1* | 12/2008 | Yonekubo | G03G 15/0266 399/44 |
| 2015/0071665 | A1* | 3/2015 | Lam | G03G 15/0851 399/60 |

* cited by examiner

IMAGE FORMING APPARATUS HAVING PHOTOSENSITIVE BODY AND CHARGING DEVICE

CROSS REFERENCE TO RELATED APPLICATION

This application claims priority from Japanese Patent Application No. 2015-044198 filed Mar. 6, 2015. The entire content of the priority application is incorporated herein by reference.

TECHNICAL FIELD

The present disclosure relates to an image forming apparatus, an image forming method, and a non-transitory computer readable storage medium storing a program used to form an image by an electrographic method. More specifically, the present disclosure relates to a charging control in an image forming apparatus.

BACKGROUND in a conventional electrophotographic image forming apparatus for forming a toner image on a photosensitive body, various controls have been proposed, in order to prevent degradation in image quality. For example, Japanese Patent Application Publication No. Hei-02-87176 discloses a configuration that handles variations in the charging characteristics of a photosensitive body with time. In this configuration, a varying degree, by which the charging characteristic of a photosensitive body varies with time, is determined in advance based on a relation between a charging voltage and a surface potential of the photosensitive body, and the charging voltage is adjusted dependently on the determined varying degree of the charging characteristics with time.

SUMMARY

In the above-described conventional configuration, residual charge which has not reached the surface of the photosensitive body exists in the inside of the photosensitive body. There is a case in which the residual charge cancels part of charge existing on the surface of the photosensitive body that has been charged by a charging device, thereby partially decreasing the surface potential of the photosensitive body to a level lower than a target potential. The decrease in the surface potential can cause degradation in image quality such as density non-uniformness and fogging. Particularly when toner images are formed continuously in succession, the amount of residual charge that exists in the photosensitive body after the photosensitive body has been exposed increases, and the image quality is degraded.

The present disclosure is to solve the above-described problems of the conventional configuration. That is, an object of the disclosure is to provide an improved image forming apparatus that can form an image by an electrophotographic method and that can suppress degradation in image quality which is caused by decrease in the surface potential of the photosensitive body due to residual charge existing in the photosensitive body.

According to one aspect, an image forming apparatus includes: an image forming portion; and a control unit. The image forming portion is configured to form a toner image. The image forming portion includes: a photosensitive body; a charging device; an exposure device; a toner supply device; and a transfer device. The charging device is configured to charge a surface of the photosensitive body. The exposure device is configured to irradiate light on the surface of the photosensitive body. The toner supply device is configured to supply toner to the photosensitive body. The transfer device is configured to transfer a toner image from the photosensitive body to transfer medium. The control unit is configured to perform: determining a continuously printed amount that has been attained by the image forming portion while the image forming portion has formed toner images continuously with a time interval between every two successive image-forming timings having a length shorter than or equal to a prescribed length, the image forming portion forming a toner image at each image-forming timing; and setting a charging voltage to be applied to the charging device based on a sum of a reference charging voltage and a correction value. The reference charging voltage is determined based on a target surface potential of the photosensitive body. The correction value is determined based on the continuously printed amount.

According to another aspect, an image forming method for an image forming apparatus is provided. The image forming apparatus includes: an image forming portion configured to form a toner image. The image forming portion includes: a photosensitive body; a charging device configured to charge a surface of the photosensitive body; an exposure device configured to irradiate light on the surface of the photosensitive body; a toner supply device configured to supply toner to the photosensitive body; and a transfer device configured to transfer a toner image from the photosensitive body to transfer medium. The image forming method includes: determining a continuously printed amount that has been attained by the image forming portion while the image forming portion has formed toner images continuously with a time interval between every two successive image-forming timings having a length shorter than or equal to a prescribed length, the image forming portion forming a toner image at each image-forming timing; and setting a charging voltage to be applied to the charging device based on a sum of a reference charging voltage and a correction value, the reference charging voltage being determined based on a target surface potential of the photosensitive body, the correction value being determined based on the continuously printed amount.

According to another aspect, a non-transitory computer readable storage medium storing a set of program instructions for an image forming apparatus is provided. The image forming apparatus includes: an image forming portion configured to form a toner image. The image forming portion includes: a photosensitive body; a charging device configured to charge a surface of the photosensitive body; an exposure device configured to irradiate light on the surface of the photosensitive body; a toner supply device configured to supply toner to the photosensitive body; and a transfer device configured to transfer a toner image from the photosensitive body to transfer medium. The program instructions, when executed by the image forming apparatus, cause the image forming apparatus to perform: determining a continuously printed amount that has been attained by the image forming portion while the image forming portion has formed toner images continuously with a time interval between every two successive image-forming timings having a length shorter than or equal to a prescribed length, the image forming portion forming a toner image at each image-forming timing; and setting a charging voltage to be applied to the charging device based on a sum of a reference charging voltage and a correction value, the reference charging voltage being determined based on a target surface potential of the photosensitive body, the correction value being determined based on the continuously printed amount.

BRIEF DESCRIPTION OF THE DRAWINGS

The particular features and advantages of the disclosure will become apparent from the following description taken in connection with the accompanying drawings, in which:

FIGS. 4A-4C illustrate how electric charge moves in the inside of the photosensitive body, in which FIG. 4A shows how charge is generated upon receipt of thermal energy, FIG. 4B shows how negative charge moves to the surface of the photosensitive body and cancels positive charge existing on the surface of the photosensitive body, and FIG. 4C shows how negative charge that originally exists in a charging range moves to reach the surface of the photosensitive body at a position downstream from the charging range in a rotating direction of the photosensitive body;

DETAILED DESCRIPTION

Figure 1:
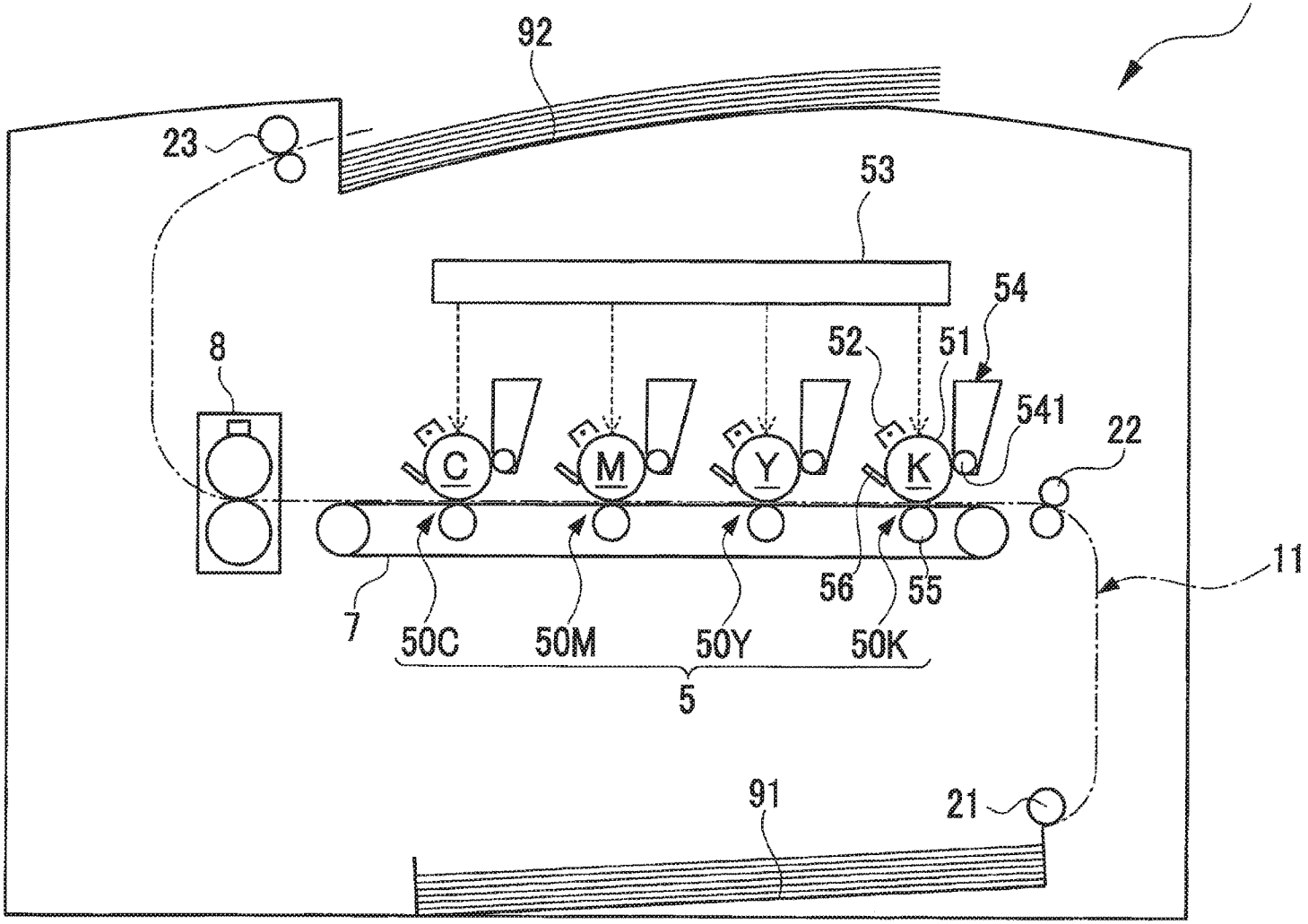
FIG. 1 is a cross-sectional side view schematically illustrating the configuration of a printer according to an embodiment.

An image forming apparatus according to an embodiment will be described while referring to the accompanying drawings wherein like parts and components are designated by the same reference numerals to avoid duplicating description. The image forming apparatus according to the embodiment is a printer having an image forming function.

A printer 100 according to the embodiment is a multicolor printer that forms a multicolor image on a sheet as a transfer target according to an electrophotographic method. As shown in FIG. 1, the printer 100 includes: an image forming section 5 configured to form a toner image and transfer the toner image onto a sheet; a conveying belt 7 configured to convey the sheet so that the sheet passes in the image forming section 5; and a fixing device 8 configured to fix the toner image on the sheet. The printer 100 further includes: a sheet feeding tray 91 configured to accommodate a sheet, onto which a toner image has not yet been transferred; and a sheet discharging tray 92 configured to receive thereon a sheet, onto which a toner image has been transferred.

The printer 100 is provided with a conveying path 11 which has a substantially S-shape as indicated by the one-dotted chain line in FIG. 1. The printer 100 includes: a sheet feeding roller 21; a registration roller 22; and a sheet discharging roller 23, all of which are configured to convey a sheet along the conveying path 11. With this configuration, the printer 100 conveys one sheet at a time from among the sheets stacked in the sheet feeding tray 91, along the conveying path 11 by using the sheet feeding roller 21, the registration roller 22, the conveying belt 7, and the sheet discharging roller 23, and discharges the sheet to the sheet discharging tray 92.

The image forming section 5 has a configuration for forming toner images of respective colors. Specifically, as shown in FIG. 1, a black process unit 50K, a yellow process unit 50Y, a magenta process unit 50M, and a cyan process unit 50C are disposed in the image forming section 5 at the same interval in the conveying direction of the conveying belt 7. The arrangement order of the process units 50 for the respective colors is not limited to the example shown in FIG. 1. The black process unit 50K, yellow process unit 50Y, magenta process unit 50M, and cyan process unit 50C will be collectively referred to as process units 50, hereinafter.

As shown in FIG. 1, the black process unit 50K includes a drum-shaped photosensitive body 51. The black process unit 50K further includes: a charging device 52; a developing device 54 including a developing roller 541; a transfer device 55; and a cleaner 56, all of which components are disposed around the photosensitive body 51. The process units 50C, 50M, and 50Y of other colors have the same configuration as the black process unit 50K except for the color of the toner. Further, the image forming section 5 includes an exposure device 53 which is shared by the process units 50Y, 50M, 50C, and 50K of respective colors. The image forming section 5 and the process units 50 are examples of the image forming portion. The photosensitive body 51 is an example of a photosensitive body, the charging device 52 is an example of a charging device, the developing device 54 is an example of a toner supply device, the transfer device 55 is an example of a transfer device, the cleaner 56 is an example of a cleaner member, and the exposure device 53 is an example of an exposure device.

Figure 2:
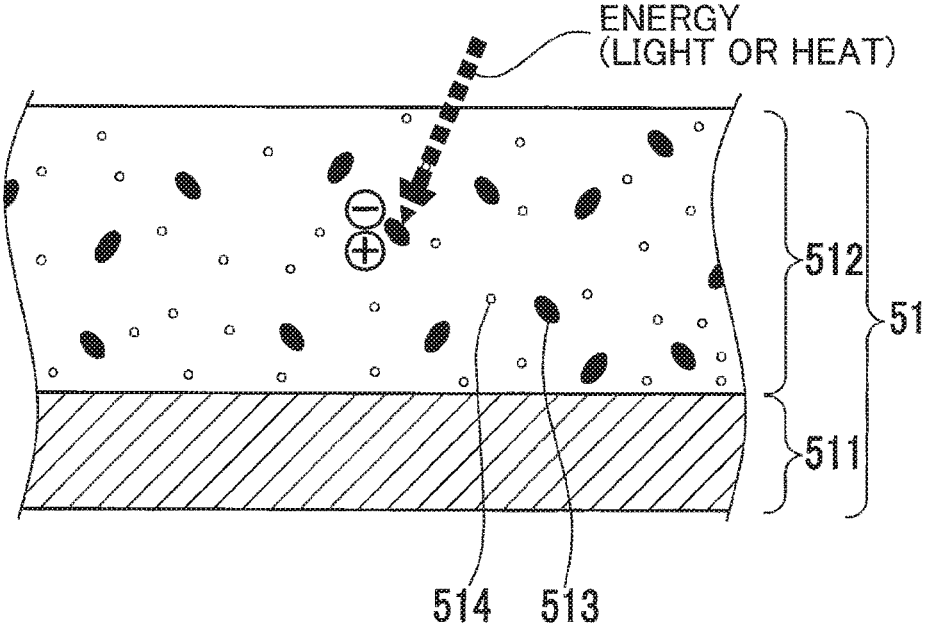
FIG. 2 illustrates part of a photosensitive body provided in the printer of FIG. 1.

FIG. 2 schematically shows a cross-section of part of the photosensitive body 51. The photosensitive body 51 includes: a metal core 511; and an organic photosensitive layer 512 formed around the metal core 511. That is, the metal core 511 which is shown at the lower part of FIG. 2 is the center of the photosensitive body 51, and the organic photosensitive layer 512 which is shown at the upper part of FIG. 2 is provided at the entire circumference of the surface of the photosensitive body 51. The metal core 511 is, for example, an aluminum pipe and is electrically grounded. The organic photosensitive layer 512 contains charge generating agent 513 and charge transporting agent 514 which are dispersed therein.

The organic photosensitive layer 512 includes polycarbonate, for example, as a base material. The charge generating agent 513 mainly contains phthalocyanines. The charge transporting agent 514 mainly contains azokinons and arylamines. The organic photosensitive layer 512 has a thickness of 30 μm in the radial direction of the photosensitive body 51. It is noted that any material other than those described above may be appropriately chosen depending on the type of toner used. The organic photosensitive layer 512 will be described in greater detail later.

The charging device 52 is of a scorotron type that includes a wire and a grid, and that charges the surface of the photosensitive body 51 by discharging so that the photosensitive body 51 has a substantially uniform charge on the surface thereof. In the description below, a grid voltage to be applied to the grid of the charging device 52 will be referred to as a "charging voltage", and a wire current to flow to the wire of the charging device 52 will be referred to as a "charging current". Further, a range in the surface of the photosensitive body 51 that can confront the charging device 52 at a time and can receive charge generated by the discharging of the charging device 52 when confronting the charging device 52 will be referred to as a "charging range". The charging range moves on the surface of the photosensitive body 51 according to the rotation of the photosensitive body 51.

The exposure device 53 is of a laser exposure type that irradiates a laser beam based on image data (print data) on the charged surface of the photosensitive body 51. As a result, an electrostatic latent image is formed on the surface of the photosensitive body 51 based on the image data. The exposure process will be described in greater detail later.

The developing device 54 accommodates toner therein. The developing device 54 electrically charges toner, and supplies the electrically-charged toner to the developing roller 541. The developing device 54 applies a prescribed amount of voltage to the developing roller 541 so as to form a potential difference between the developing roller 541 and the electrostatic latent image on the photosensitive body 51, thereby supplying the electrically-charged toner onto the electrostatic latent image on the photosensitive body 51. Thus, a toner image is formed on the photosensitive body 51. The transfer device 55 is disposed in parallel to the photosensitive body 51 with the conveying belt 7 interposed therebetween. When a transfer current flows in the transfer device 55, the transfer device 55 electrically attracts the toner image on the photosensitive body 51 so that the toner image is transferred onto the sheet conveyed by the conveying belt 7.

The cleaner 56 is a cleaning blade configured such that one end of the cleaner 56 contacts the photosensitive body 51 and scrapes off the toner that remains on the photosensitive body 51 after the transfer operation is performed, thereby removing the toner. The cleaner 56 contacts the photosensitive body 51 in a counter direction relative to the rotating direction of the photosensitive body 51. For example, in FIG. 1, the photosensitive body 51 rotates in the clockwise direction of the drawing. The cleaner 56 is pressed against the photosensitive body 51 at a contact position between the cleaner 56 and the photosensitive body 51 so that a vector of a pressing force pressing the cleaner 56 against the photosensitive body 51 has a component in a direction opposite to the traveling direction of the surface of the photosensitive body 51.

The printer 100 forms an image by using positively charged single-component toner. More specifically, during a printing process, the surface of the photosensitive body 51 is positively charged by the charging device 52. Then, part of the surface of the photosensitive body 51 is exposed to light by the exposure device 53 so that the potential becomes partially lowered on the surface of the photosensitive body 51. Toner stored in the developing device 54 is positively charged in the developing device 54 and is moved to the portion of the surface of the photosensitive body 51 whose potential is lowered.

During the printing process, the printer 100 extracts sheets one by one from among the sheets stacked on the sheet feeding tray 91, and conveys the sheet onto the conveying belt 7. The transfer device 55 is applied with a transfer current to have a negative potential, and attracts toner on the photosensitive body 51 at a timing that is synchronized with the sheet conveying timing so that the toner image is transferred onto the sheet.

In order to form a multi-color image, the printer 100 sequentially transfers the toner images of respective colors formed on the photosensitive bodies 51 onto a sheet so that the toner of the respective colors are superimposed on one another to font a multicolor image. In order to form a monochrome image, the printer 100 controls only the black process unit 50K to operate. Subsequently, the printer 100 conveys the sheet having the toner image transferred thereon to the fixing device 8 and thermally fixes the toner image onto the sheet. Then, the sheet fixed with the toner image thereon is discharged to the sheet discharging tray 92.

Figure 3:
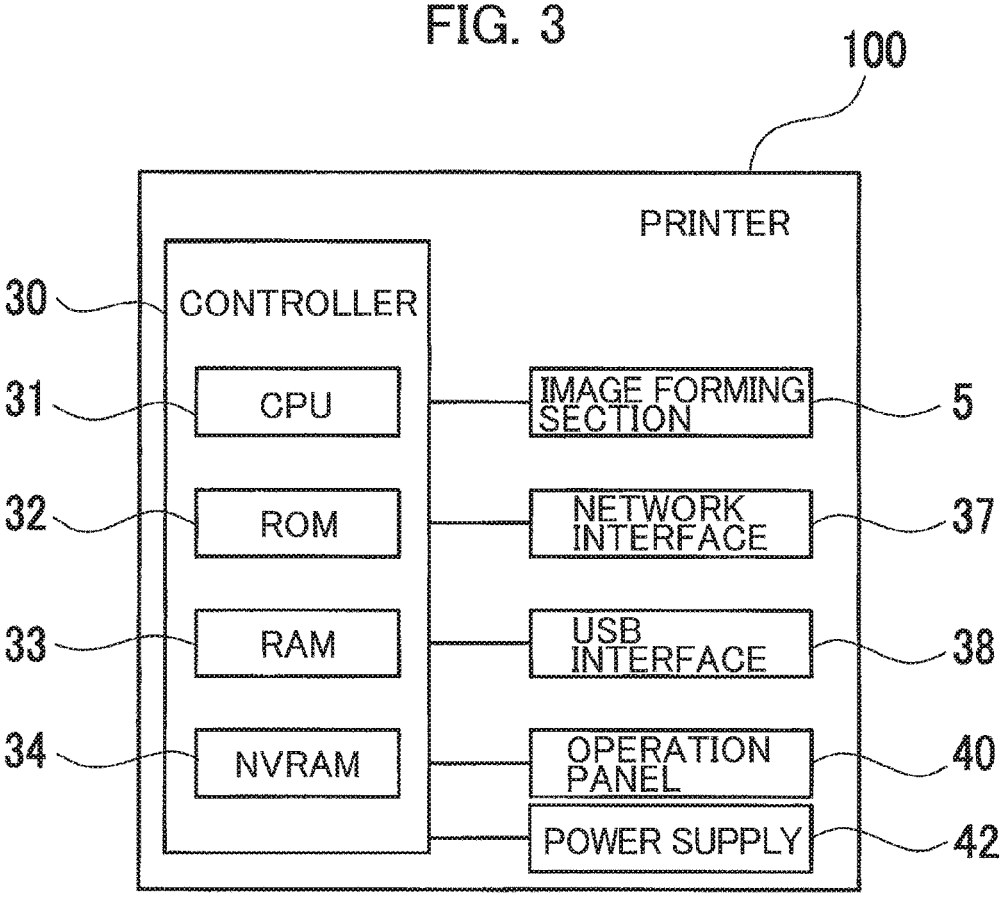
FIG. 3 is a block diagram illustrating the electrical configuration of the printer.

Next will be described the electric configuration of the printer 100. As shown in FIG. 3, the printer 100 includes a controller 30 having a CPU 31, a ROM 32, a RAM 33, and a NVRAM (Non-volatile RAM) 34. The printer 100 further includes the image forming section 5, a network interface 37, a USB interface 38, an operation panel 40, and a power supply 42, which are electrically connected to the controller 30. The term "controller 30" is a generic term collectively representing hardware, including the CPU 31, that is used for controlling the printer 100, and is not intended to mean only one hardware from among one or more hardware that actually exists in the printer 100.

The ROM 32 stores therein: a firmware which is control programs for controlling the printer 100; various settings; and initial values. The control programs include a control program for a sheet number monitoring process according to the present embodiment to be described later. The RAM 33 is used as a working area in which various control programs are read, and is used also as a storage area in which image data is temporarily stored. In accordance with the control programs read from the ROM 32 and signals transmitted from various sensors, the CPU 31 controls the components in the printer 100 while storing processed results in the RAM 33 or the NVRAM 34. The CPU 31 is an example of a control unit. The controller 30 may be an example of a control unit. The NVRAM 34 is an example of a storage unit.

The network interface 37 is hardware used to communicate with devices that are connected to the printer 100 via a network using a LAN cable. The USB interface 38 is hardware used to communicate with devices that are connected to the printer 100 via a USB cable. The operation panel 40 is hardware used to display a notification to a user and to receive a command inputted from a user. The operation panel 40 includes, for example, a liquid crystal display and a group of buttons including a start key, a stop key, a numerical pad, and a power key for inputting a user's instruction to turn ON or OFF the power supply 42. When the power key in the operation panel 40 is operated to turn ON the power supply 42, the power supply 42 starts supplying power to respective portions in the printer 100, such as the controller 30, the image forming section 5, and the process units 50.

Next will be described how to set a charging voltage in the printer 100.

Now assume that the surface potential of the photosensitive body 51 becomes partially lowered within a range that is immediately downstream of the charging range and is immediately upstream of a position where the photosensitive body 51 is exposed by the exposure device 53 in the rotating direction of the photosensitive body 51. In other words, now assume that the surface potential of the photosensitive body 51 becomes partially lowered immediately after the photosensitive body 51 is charged and immediately before the photosensitive body 51 is exposed to light. In such a case, differences in the potentials between the potential-lowered portions and the exposed portions become relatively small. It is noted that the charged amounts of the charged toner are not uniform, but are distributed to some extent. Accordingly, toner having relatively large charged amounts will possibly be attached to the surface of the photosensitive body 51 at the potential-lowered portions other than the exposed portions. This degrades the image quality. For example, although a line having a uniform width is formed as an electrostatic latent image, a line whose width is partially large is formed as a toner image. In order to suppress the degradation in image quality, it is desirable that the unexposed portions on the photosensitive body 51 have a uniform surface potential with small variations when the unexposed portions are at a position that is immediately upstream of the position where the photosensitive body 51 is subjected to development by the development device 54 in the rotating direction of the photosensitive body 51. In other words, it is desirable that the unexposed portions on the photosensitive body 51 have a uniform surface potential with small variations, immediately before being subjected to development.

The photosensitive body 51 includes the organic photosensitive layer 512 containing both of the charge generating agent 513 and charge transporting agent 514 as shown in FIG. 2. The charge generating agent 513 generates positive charge and negative charge upon receipt of energy such as light or heat. The generated charge is transported by the charge transporting agent 514 to move inside the organic photosensitive layer 512. More specifically, due to the potential difference between the surface of the photosensitive body 51 and the metal core 511, the positive charge and the negative charge are separated from each other and move toward the center and the surface of the photosensitive body 51, respectively.

For example, in the state where the surface of the photosensitive body 51 is positively charged relative to the ground level of the metal core 511, the negative charge moves toward the surface of the photosensitive body 51 and the positive charge moves toward the metal core 511 as shown in FIG. 2. As the surface potential of the photosensitive body 51 is greater, the force attracting the negative charge is greater and the moving speed of the negative charge is faster. When the negative charge reaches the surface of the photosensitive body 51, the negative charge is coupled to the positive charge existing on the surface of the photosensitive body 51, to thereby cancel the positive charge. The potential on the surface of the photosensitive body 51 is lowered at the position where the positive charge is canceled.

In order to use positively charged toner as described above, the charging device 52 positively charges the surface of the photosensitive body 51 so that the surface of the photosensitive body 51 has the positive potential. Thereafter, the exposure device 53 exposes the surface of the photosensitive body 51 to light. As a result, charge is generated in the organic photosensitive layer 512 due to energy of the laser beam. Because the surface of the photosensitive body 51 has the positive potential, the negative charge in the generated charge is attracted to the surface of the photosensitive body 51 and lowers the surface potential of the photosensitive body 51 at the light-irradiated portions. As a result, an electrostatic latent image is formed on the surface of the photosensitive body 51. Then, by using positively charged toner, the developing device 54 develops the electrostatic latent image whose potential is lowered.

Figure 4A:
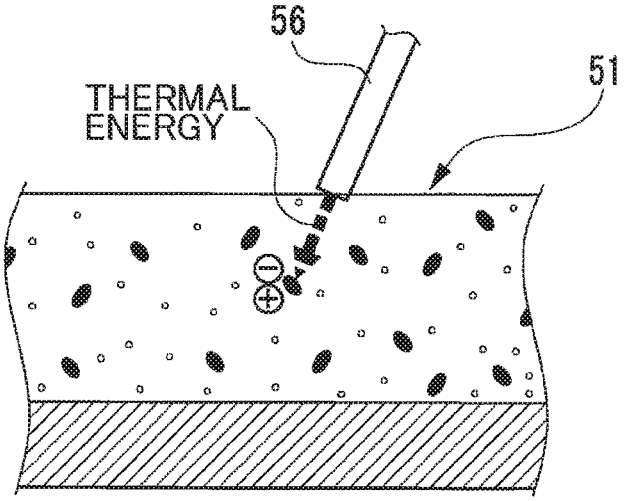

As described above, in the printer 100 of the embodiment, the cleaner 56 contacts the surface of the photosensitive body 51. In particular, the cleaner 56 is a contact type blade member and is pressed against the surface of the photosensitive body 51. For that reason, friction heat is generated at the contact portion between the photosensitive body 51 and the cleaner 56. As shown in FIG. 4A, in response to energy of the friction heat, charge will possibly be generated inside the organic photosensitive layer 512 of the photosensitive body 51.

Figure 4B:
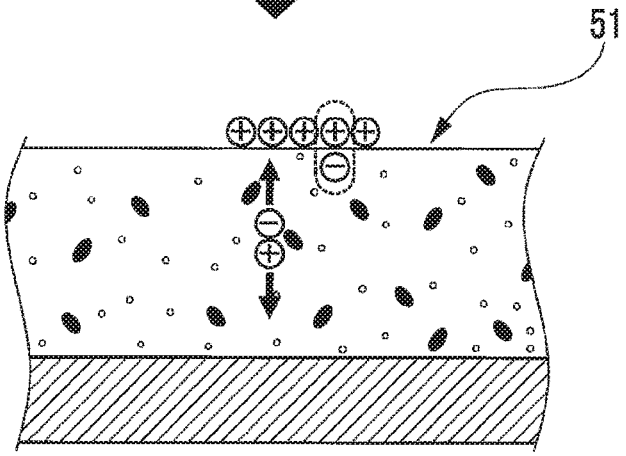

The charge generated at the contact portion between the cleaner 56 and the photosensitive body 51 moves similarly to the charge generated at the exposed portions. That is, as shown in FIG. 4B, the negative charge in the generated charge moves toward the positively charged surface of the photosensitive body 51. The negative charge that reaches the surface of the photosensitive body 51 is coupled to the positive charge on the surface of the photosensitive body as surrounded by the dashed line in FIG. 4B. As a result, the positive charge is canceled, and the potential of the photosensitive body 51 at the contact portion with the cleaner 56 is lowered. Among the residual charge which has been generated within the organic photosensitive layer 512 and has not yet reached the surface of the photosensitive body 51, the negative charge will possibly lower the potential at the surface of the photosensitive body 51. In the description below, therefore, among the residual charge remaining inside the photosensitive body 51, charge whose polarity is opposite to the polarity of the photosensitive body 51 charged by the charging device 52 will simply be referred to as "residual charge".

Figure 4C:
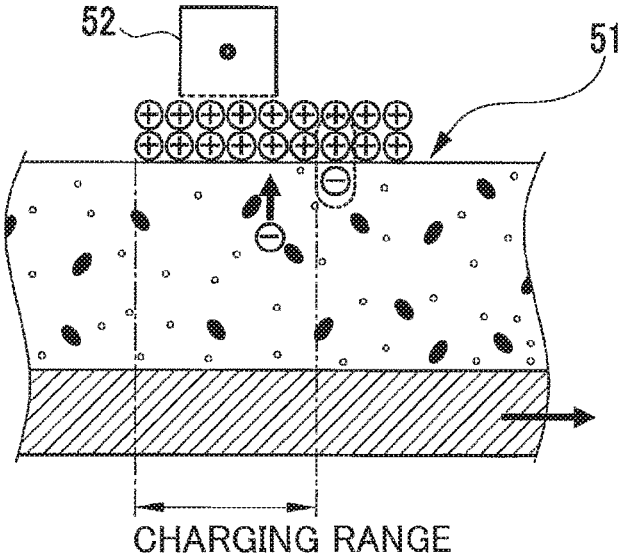

If the surface charge of the photosensitive body 51 is canceled by the residual charge at a position that is downstream of the position where the photosensitive body 51 is charged (charging range) and is upstream of the position where the photosensitive body 51 is subjected to development in the rotating direction of the photosensitive body, the cancellation of the positive charge will possibly influence the printing density. In other words, if the surface charge of the photosensitive body 51 is canceled by the residual charge after the photosensitive body 51 is charged and before the photosensitive body 51 is subjected to development, the cancellation of the positive charge will possibly influence the printing density. For example, as shown in FIG. 4C, if the residual charge reaches the surface of the photosensitive body 51 at a portion immediately downstream of the charging range, the potential of the photosensitive body 51 becomes lowered at the portion immediately downstream of the charging range. That is, if the residual charge reaches the surface of the photosensitive body 51 at a portion that has been already charged, the potential of the photosensitive body 51 becomes lowered at the already charged portion. It is noted that the portion of the photosensitive body 51 illustrated in FIG. 4C moves rightward in the drawing according to the rotation of the photosensitive body 51. If a relatively large amount of residual charge exists in the charging range, a relatively large amount of residual charge will highly possibly reach the surface of the photosensitive body 51 at a position downstream of the charging range in the photosensitive body rotating direction. In other words, if a relatively large amount of residual charge exists in the charging range, a relatively large amount of residual charge will highly possibly reach a portion of the surface of the photosensitive body 51 that has been already charged. According to the printer 100 of the embodiment, however, the charging voltage is controlled to ensure that the surface potential of the photosensitive body 51 will become equal to or larger than a prescribed target surface potential even if the positive charge is canceled by the residual charge after the surface of the photosensitive body 51 is charged.

The contact portion between the cleaner 56 and the photosensitive body 51 is located at a position that is downstream of a position where the transfer device 55 performs a transferring process and is upstream of the charging range where the charging device 53 performs a charging process in the rotating direction of the photosensitive body 51. In other words, the contact portion between the cleaner 56 and the photosensitive body 51 is located at such a portion from which a toner image has been already transferred by the transfer device 55 and has not yet been charged by the charging device 53. For that reason, the charge generated due to the friction heat by the cleaner 56 may possibly become such residual charge that exists in the charging range. Particularly when the amount of the generated charge is relatively large or the moving speed of the negative charge is relatively slow, the amount of the residual charge that exist in the charging range will highly possibly become relatively large.

In the printer 100, the amount of residual charge existing inside the photosensitive body 51 increases as printing is executed continuously in succession. It is supposed that this phenomenon is caused because charge is generated continuously due to the repeatedly-executed exposure by the exposure device 53 and the repeatedly-executed cleaning by the cleaner 56. The amount of the generated charge becomes larger than the amount of charge that reaches the surface of the photosensitive body 51 and is canceled at the surface of the photosensitive body 51. As a result, the amount, by which the surface potential of the photosensitive body 51 is decreased at the position downstream of the charging range due to the residual charge, increases as printing is executed continuously in succession. In other words, the amount, by which the surface potential of the photosensitive body 51 is decreased due to the residual charge after the photosensitive body 51 is charged, increases as printing is executed continuously in succession. To compensate for this lowering of the surface potential, according to the printer 100 of the embodiment, the printed amount is determined, and the charging voltage is corrected based on the determined printed amount.

The printed amount is, for example, a number indicative of at least one of: a number of rotations (rotation number) of the photosensitive body 51; a length of the charging time of the charging device 52; a length of the exposure time of the exposure device 53, or a number that can be converted into at least one of the above-listed values (the rotation number, charging time, and exposure time). In the embodiment, the number of printed A4-size sheets is used as the printed amount. For example, the rotation number of the photosensitive body 51 can be calculated based on the number of printed A4-sized sheets.

Specifically, the charging voltage of the printer 100 is determined based on a sum of a new product reference charging voltage and the correction value. The new product reference charging voltage is, for example, a charging voltage that is required to be applied to the charging device 52 so as to charge the photosensitive body 51 to a target surface potential when the photosensitive body 51 is a new product. The printer 100 sets the new product reference charging voltage based on: the temperature and the humidity inside the apparatus 100; and print settings. Hereinafter, the new product reference charging voltage will be referred to as a "new product reference charging voltage V0". As described above, in the printer 100 of the embodiment, the charging voltage is a positive value, and respective correction values for correcting the charging voltage are also positive values.

The correction values depend on the printed amount. More specifically, the printer 100 of the embodiment counts, as the printed amount, the number m1 of continuously-printed sheets and the number m2 of accumulated printed sheets, and stores both of the counted values m1 and m2 in the NVRAM 34. In the embodiment, if printings are executed in succession with time intervals shorter than or equal to a prescribed time length T, it is called that printings are executed "continuously". The prescribed time length T will be described later. In addition, a series of successively-executed printings, which are executed with a time interval between every two successive printings having a length shorter than or equal to the prescribed time length T, is defined as a continuous printing process. The number m1 of continuously-printed sheets is defined as a total number of sheets which have been printed continuously until the current time. The number m2 of accumulated printed sheets is defined as a total number of printed sheets that has been accumulated until the current time from when a process unit 50, in which a new product of the photosensitive body 51 was provided, was newly mounted in the printer 100. The printer 100 counts both of the sheet numbers m1 and m2 for each color, that is, for each process unit 50. For each color, that is, for each process unit 50, the printer 100 resets the number m2 of accumulated printed sheets to zero (0) when the photosensitive body 51 in the process unit 50 is replaced with a new product of the photosensitive body 51. For example, the printer 100 resets the number m2 of accumulated printed sheets for one color to zero (0) when the corresponding process unit 50 is replaced with a process unit 50 in which a new product of the photosensitive body 51 is provided. The printer 100 sets the correction values such that each correction value increases as the number m1 of continuously-printed sheets or the number m2 of accumulated printed sheets stored therein increases. The printer 100 sets the correction values for each color, that is, for each process unit 50.

Next will be described, with reference to FIG. 5, the procedures of the sheet number monitoring process according to the present embodiment. The sheet number monitoring process is for controlling the charging voltage dependently on the number of printed sheets. The CPU 31 starts executing the sheet number monitoring process when the power supply 42 is turned on. The CPU 31 executes the sheet number monitoring process for each color, that is, for each processing unit 50.

In the sheet number monitoring process, the CPU 31 first clears the length of a printing stop period to zero (0) in S101. The printing stop period is a continuous period in which printing is not performed. The "printing stop period" will be described later. Then, in S102, the CPU 31 clears the number m1 of continuously-printed sheets to zero (0). In the printer 100, the CPU 31 does not acquire data of a power-off period (a period of time, during which the power supply 42 is being off), and therefore the CPU 31 does not know how long printing has stopped before the power supply 42 is turned ON. Accordingly, in S102, the CPU 31 resets the number m1 of the continuously-printed sheets by assuming that the length of the power-off period has exceeded the prescribed time length T. It is noted that the number m1 of continuously-printed sheets may be stored in the RAM 33. In such a case, the process of S102 is omitted.

Then, in S103, the CPU 31 determines whether the power-off instruction has been received. When the CPU 31 determines that the power-off instruction has been received (S103: YES), the CPU 31 ends the sheet number monitoring process.

When the power-off instruction has not been received (S103: NO), the CPU 31 determines in S105 whether a print job is received. When a print job is received (S105: YES), the CPU 31 clears the length of the printing stop period to zero (0) in S107. The CPU 31 then performs a printing process in S108.

Next, the printing process of S108 will be described with reference to FIG. 6.

In the printing process, first in S201, the CPU 31 starts both of a warming-up operation for the fixing device 8 and a printing preparation operation for respective parts in the printer 100. Then, in S202, the CPU 31 performs a charging control process for determining a charging voltage to be applied to the charging device 52.

Figure 7:
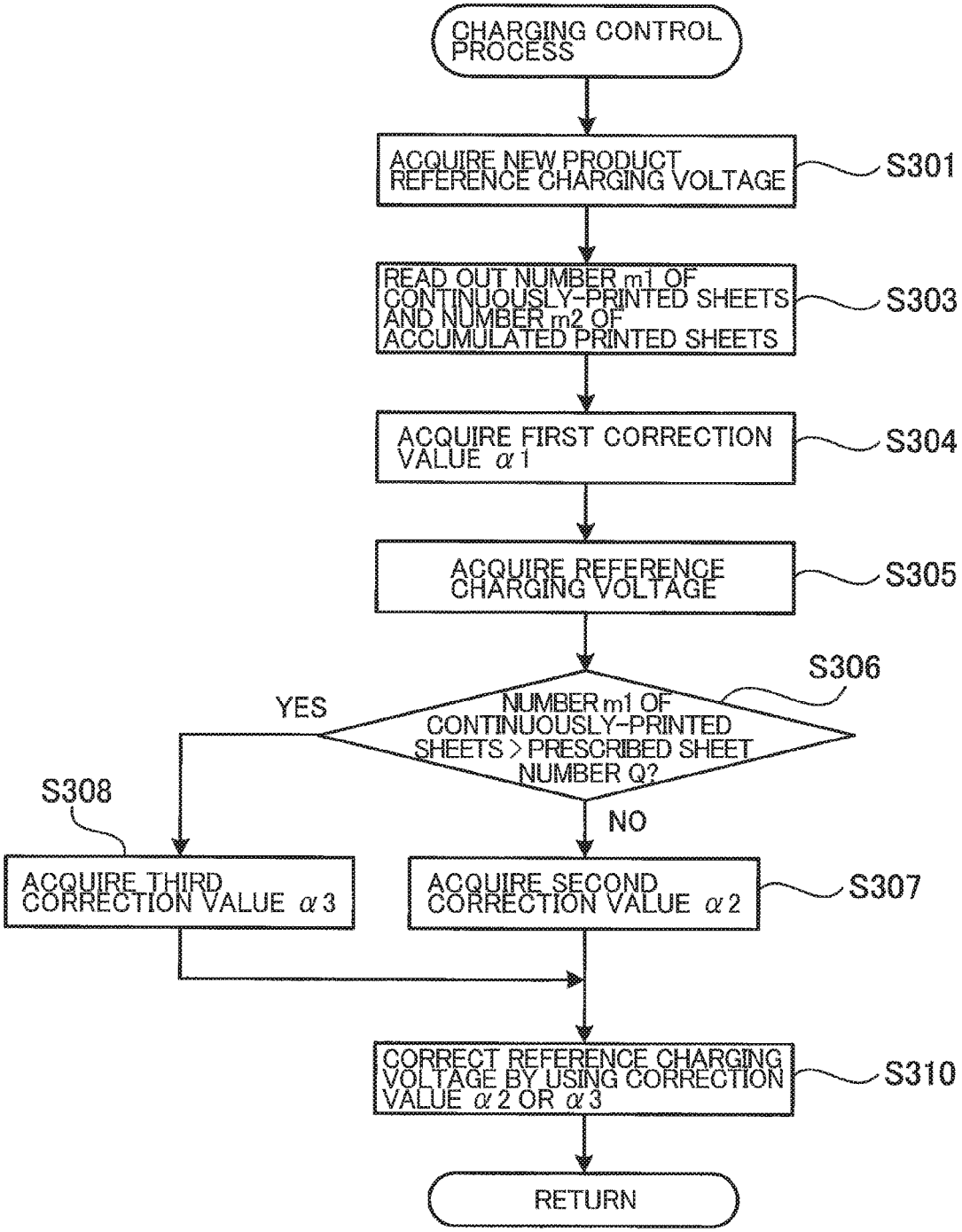
FIG. 7 is a flowchart of a charging control process shown in FIG. 6.

Next, the charging control process of S202 will be described with reference to FIG. 7.

In the charging control process, first in S301, the CPU 31 acquires the new product reference charging voltage V0. The new product reference charging voltage V0 is such a charging voltage that should be used to a new product of the photosensitive body 51. In other words, the new product reference charging voltage V0 should be applied when the process unit 50 having a new product of the photosensitive body 51 provided therein is newly mounted in the printer 100, that is, when the number m2 of accumulated printed sheets for the process unit 50 is equal to zero (0). It is noted that the CPU 31 determines the amount of the new product reference charging voltage V0 based on, for example, the target surface potential of the photosensitive body 51, the temperature and humidity inside the printer 100, and the print settings.

Then, in S303, the CPU 31 reads out, from the NVRAM 34, the number m1 of continuously-printed sheets and the number m2 of accumulated printed sheets. As described above, the number m1 of continuously-printed sheets indicates the number of sheets that have been printed substantially continuously up to the current time, that is, the number of sheets that have been printed in succession with time intervals shorter than or equal to the prescribed time length T up to the current time. The number m2 of accumulated printed sheets indicates the total number of sheets that have been printed from when the photosensitive body 51 mounted in the printer 100 was a new product and until the current time. The printer 100 resets the number m2 of accumulated printed sheets when the photosensitive body 51 mounted in the printer 100 is replaced by a new product of the photosensitive body 51. The number m1 of continuously-printed sheets is an example of a continuously printed amount, and the number m2 of accumulated printed sheets is an example of an accumulated printed amount.

Figure 8:
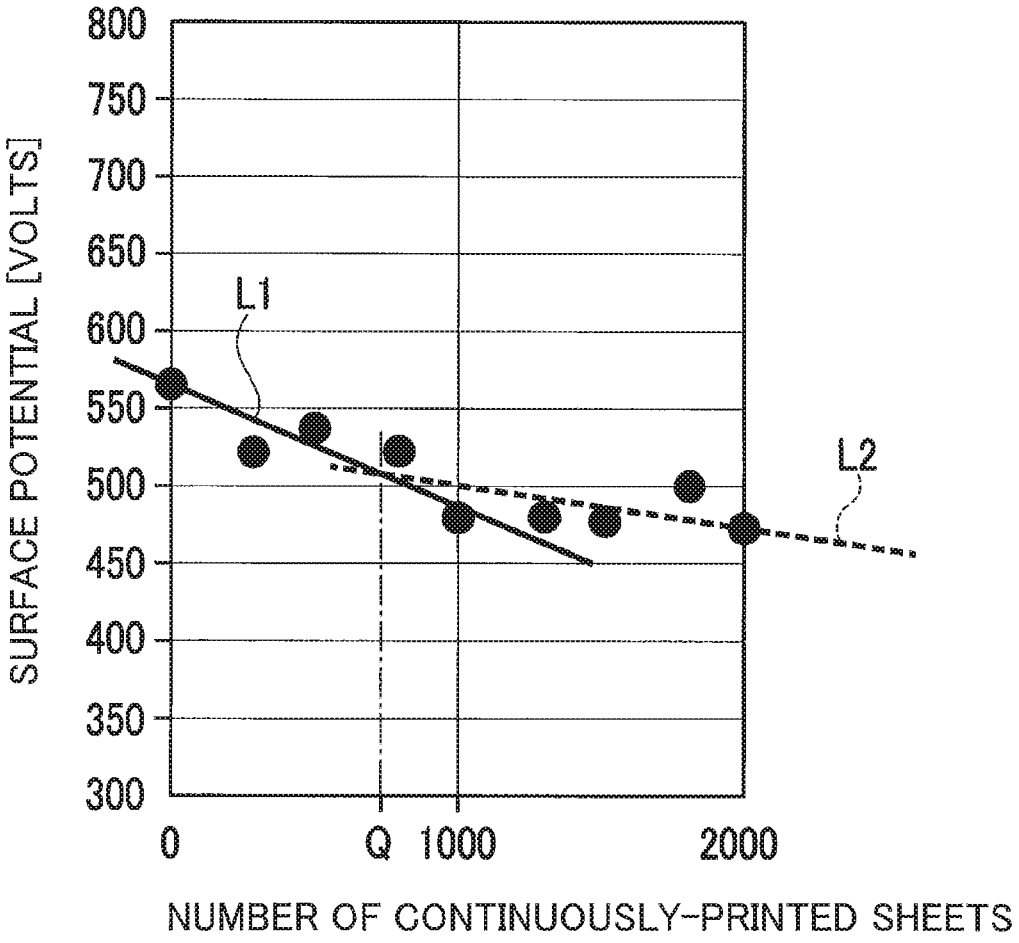
FIG. 8 is a graph showing a relationship between the number of continuously-printed sheets and a surface potential of the photosensitive body.

In the printer 100, in the case where printing is continuously performed while maintaining constant the amount of the charging voltage applied to the charging device 52, the surface potential of the photosensitive body 51 gradually decreases as the number m1 of continuously-printed sheets increases and the number m2 of accumulated printed sheets increases. It is noted, however, that the surface potential does not decrease linearly in accordance with the increase in the number of printed sheets. For example, as shown in FIG. 8, when the number m1 of continuously-printed sheets is greater than a prescribed sheet number Q, the rate, at which the surface potential decreases in accordance with the increase in the number of printed sheets, is smaller in comparison with the case where the number m1 of continuously-printed sheets is smaller than or equal to the prescribed sheet number Q. The prescribed sheet number Q is an example of a prescribed amount.

FIG. 8 is a graph illustrating an example of measurement results showing how the surface potential of the photosensitive body 51 changed with respect to the number of printed sheets when printing was performed continuously on 2,000 sheets in succession. By repeating the same experiments, it was found that the rate, at which the surface potential decreases in accordance with the increase in the number of printed sheets, becomes lowered after printing has been performed continuously on 500 to 1,000 sheets by the printer 100. Specifically, as shown in FIG. 8, the surface potential of the charged photosensitive body 51 decreases along a line L1 when the number m1 of continuously-printed sheets is smaller than the prescribed sheet number Q and decreases along a line L2 when the number m1 of continuously-printed sheets exceeds the prescribed sheet number Q. The absolute value of the inclination of the line L2 is smaller than that of the line L1.

It can be supposed that ozone may possibly cause changes in the rate, at which the surface potential decreases with respect to the number m1 of continuously-printed sheets. When printing is performed in the electrophotographic printer 100, ozone is generated inside the printer 100. Ozone is an unstable molecule which is liable to be decomposed into oxygen and oxygen ion. The oxygen ion is highly acidic, and chemically degrades the charge transporting agent 514 existing near the surface of the photosensitive body 51, to thereby deteriorate the transporting function of the charge transporting agent 514. The oxygen ion, however, chemically degrades only such charge transporting agent 514 that exists in the vicinity of the surface of the photosensitive body 51. It can therefore be supposed that the degree, by which the transporting function is deteriorated, becomes lowered after most part of the charge transporting agent 514 existing near the surface is chemically degraded. For that reason, it can be supposed that the amount, by which the surface potential of the photosensitive body 51 decreases due to ozone, becomes small when printing has been performed continuously for some period of time or longer. The prescribed sheet number Q is selected dependently on the material and size of the photosensitive body 51.

Figure 9:
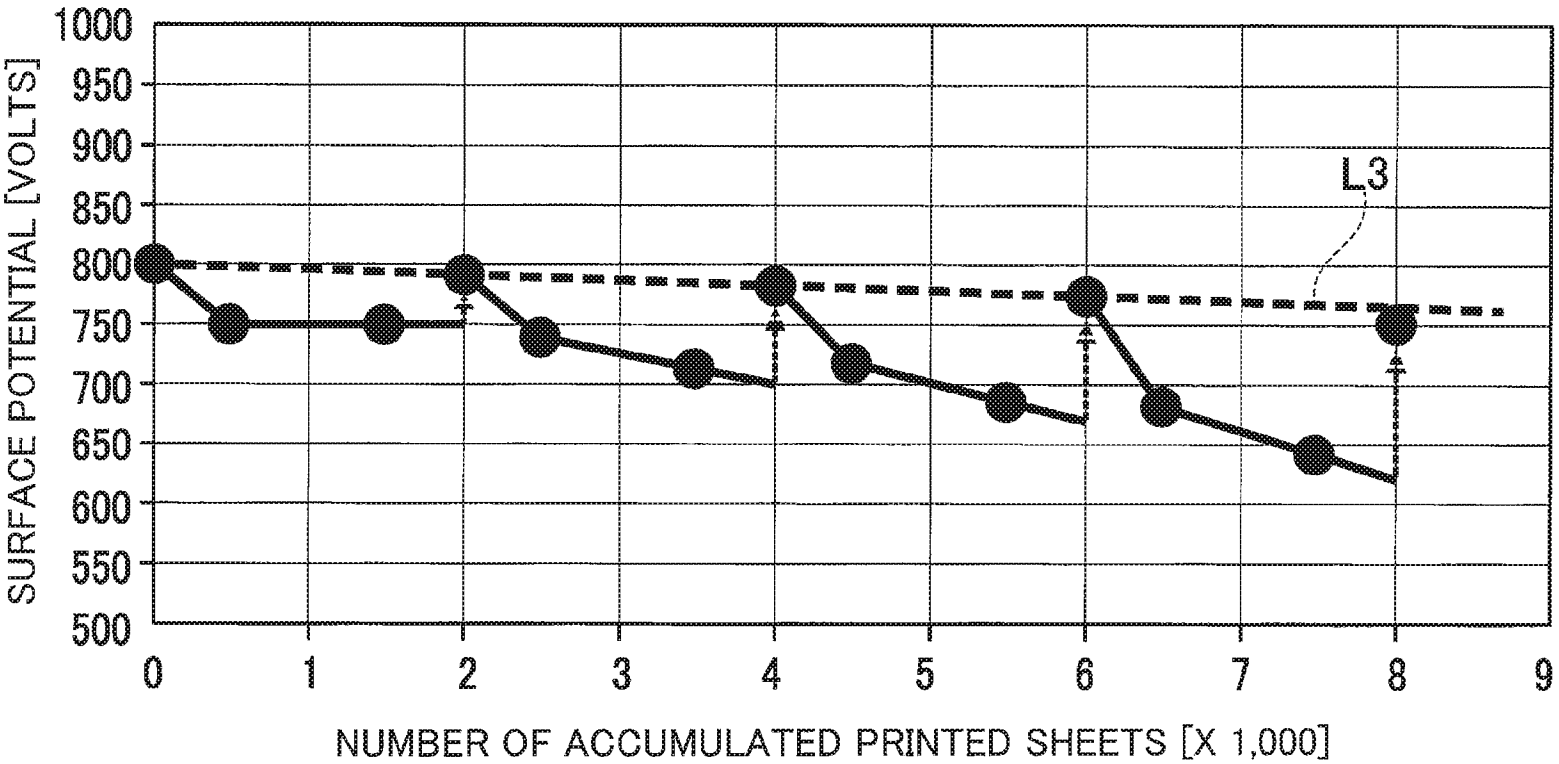
FIG. 9 is a graph showing a relationship between the number of accumulated printed sheets and the surface potential of the photosensitive body.

After printing is executed with the charging device 52 applied with some amount of charging voltage, if printing is stopped for a printing stop period of a length longer than the prescribed time length T, the surface potential of the photosensitive body 51 that is attained immediately after the printing stop period, becomes greater than the surface potential of the photosensitive body 51 that is attained immediately before the printing stop period. For example, as shown in FIG. 9, when the continuous printing process, in which printings are executed in succession with time intervals shorter than or equal to the prescribed length T, and the printing stop period of a length longer than the prescribed length T are repeated alternately in succession, the surface potential or the photosensitive body 51 decreases during each continuous printing process, but is recovered, after each printing stop period, to a level that is higher than that immediately before the subject printing stop period. FIG. 9 is a graph illustrating an example of measurement results showing how the surface potential of the photosensitive body 51 changed with respect to the number m2 of accumulated printed sheets when the continuous printing process onto 2,000 sheets and the printing stop period of 10 hours or more were repeated in alternation.

The printing stop period is a continuous period of time, during which the charging process is not performed by the charging device 52, and also is a continuous period of time, during which irradiation of light from the exposure device 53 onto the photosensitive body 51 is not performed. The length of the printing stop period can therefore be determined based on a continuous period of time, during which the charging device 52 does not perform the charging process, or based on the continuous period of time, during which the exposure device 53 does not perform irradiation of light onto the photosensitive body 51. It can be supposed that during the printing stop period, residual charge is not newly generated, and relatively large part of the residual charge inside the photosensitive body 51 reaches the surface of the photosensitive body 51 and is canceled with the surface charge, as a result of which the amount of the residual charge inside the photosensitive body 51 decreases. The printing stop period is an example of a non-exposure time. The prescribed time length T is an example of a prescribed length.

It is noted, however, that the surface potential of the photosensitive body 51, which is attained immediately after every printing stop period, decreases as the number m2 of accumulated printed sheets increases. It can be supposed that the charging performance of the photosensitive body 51 is degraded as the charging process is repeated. Specifically, as shown in FIG. 9, the surface potential of the photosensitive body 51 that is attained immediately after every printing stop period decreases along a line L3 with respect to the number m2 of accumulated printed sheets. By repeatedly performing the experiments similar to the example of FIG. 9, it was found that by setting the length of each printing stop period to a value longer than or equal to a prescribed time length of about five (5) hours, for example, the surface potential is recovered substantially to the line L3, although the surface potential is not completely recovered. It was also found that the surface potential can be recovered to some extent even by stopping printing for about only ten (10) minutes. In the embodiment, the prescribed time length T is selected based on the measurement results to ensure that the surface potential of the photosensitive body 51 decreases along the line L3 as shown in FIG. 9 in the case where the continuous printing process, in which printings are executed in succession with time intervals shorter than or equal to the time length T, and the printing stop period of a length longer than the prescribed time length T are repeated in alternation.

Further, in the case where the continuous printing process and the printing stop period of the prescribed length T or more are repeated in alternation, as shown in FIG. 9, the rate, at which the surface potential decreases with respect to the increase in the number of printed sheets during each continuous printing process, gradually increases in accordance with the increase in the number m2 of accumulated printed sheets. That is, the inclination degrees of the lines L1 and L2 are not fixed, but gradually increase in accordance with the increase of the number m2 of accumulated printed sheets. It can be supposed that this is because the amount of the residual charge inside the photosensitive body 51 increases in accordance with the increase in the number m2 of accumulated printed sheets.

Based on the above-described measurement results, according to the embodiment, the absolute value of the inclination of the line L1 is set as a coefficient k1, the absolute value of the inclination of the line L2 is set as a coefficient k2, and the absolute value of the inclination of the line L3 is set as the coefficient k3. The coefficient k1 is larger than the coefficient k2. The coefficients k1 and k2 change in accordance with increase in the number m2 of accumulated printed sheets such that both of the coefficients k1 and k2 increase as the number m2 of accumulated printed sheets increases. As shown in FIG. 9, for example, as to the two successive continuous printing processes that are immediately before and after the same printing stop period (preceding continuous printing process and current continuous printing process), the coefficient k1 for the current continuous printing process is larger than the coefficient k1 for the preceding continuous printing process. Similarly, the coefficient k2 for the current continuous printing process is larger than the coefficient k2 for the preceding continuous printing process. The coefficient k3 is a fixed value that is dependent on the type of the photosensitive body 51, and is stored in advance in the ROM 32.

In the present embodiment, correction values compensating for decrease in the surface potential are calculated based on the number m1 of continuously-printed sheets and the number m2 of accumulated printed sheets. The charging voltage to be applied to the charging device 52 is determined based on the calculation results. That is, in order to compensate for the decrease in the surface potential, the charging device 52 is applied with the charging voltage whose absolute value is increased by an amount that corresponds to the amount, by which the surface potential decreases.

More specifically, in the charging control process, the CPU 31 obtains various correction values for correcting the new product reference charging voltage V0 by using the number m1 of continuously-printed sheets and the number m2 of accumulated printed sheets that are read in S303.

More specifically, in S304, the CPU 31 acquires a first correction value α1 according to the following equation (Equation 1):

$$\alpha 1 = k3 \times (m2 - m1) \quad \text{(Equation 1)}$$

The first correction value α1 is a correction value that was used at the time when the current continuous printing process started. The part (m2−m1) in (Equation 1) indicates the number of printed sheets which had been accumulated at the time when the current continuous printing process started.

Then, in S305, the CPU 31 acquires a reference charging voltage V1 by adding the first correction value α1 acquired in S304 to the new product reference charging voltage V0 acquired in S301. The reference charging voltage V1 is a reference charging voltage that was applied to the charging device 52 at the time when the current continuous printing process started. For example, the reference charging voltage V1 is a reference charging voltage that should be applied to the charging device 52 when the printer 100 which has been turned off during night is turned on. It is noted that because the part (m2−m1) is larger than or equal to zero (0), the reference charging voltage V1 is equal to or larger than the new product reference charging voltage V0, and increases in accordance with the increase in the number m2 of accumulated printed sheets.

Next, the CPU 31 acquires a second correction value α2 or a third correction value α3 as a correction value that should be used after the current continuous printing process has started. More specifically, the CPU 31 determines in S306 whether the number m1 of continuously-printed sheets has exceeded the prescribed sheet number Q during the current continuous printing process. This is because the rate, at which the surface potential changes, differently in accordance with whether or not the number m1 of continuously-printed sheets exceeds the prescribed sheet number Q as described already.

When the number m1 of continuously-printed sheets is smaller than or equal to the prescribed sheet number Q (S306: NO), the CPU 31 acquires the second correction value α2 by the following equation (Equation 2) (S307):

$$\alpha 2 = k1 \times m1 \quad \text{(Equation 2)}$$

The second correction value α2 is a value obtained by multiplying the number m1 of continuously-printed sheets by the coefficient k1. The coefficient k1 in (Equation 2) is an example of a first correction coefficient.

On the other hand, when the number m1 of continuously-printed sheets is greater than the prescribed sheet number Q (S306: YES), the CPU 31 acquires the third correction value α3 according to the following equation (Equation 3) (S308):

$$\alpha 3 = (k1 \times Q) + (k2 \times (m1 - Q)) \quad \text{(Equation 3)}$$

The third correction value α3 indicates a value that is obtained by adding, to a second correction value α2 that was obtained at the time when the number m1 of continuously-printed sheets reached the prescribed sheet number Q, a correction value that is obtained by multiplying, by the coefficient k2, the number of printed sheets that have been printed after the number m1 of continuously-printed sheets reached the prescribed sheet number Q. The coefficient k2 in (Equation 3) is an example of a second correction coefficient.

Next, in S310, the CPU 31 adds, to the reference charging voltage V1, the second correction value α2 acquired in S307 or the third correction value α3 acquired in S308, thereby obtaining a corrected charging voltage, and ends the charging control process.

Figure 6:
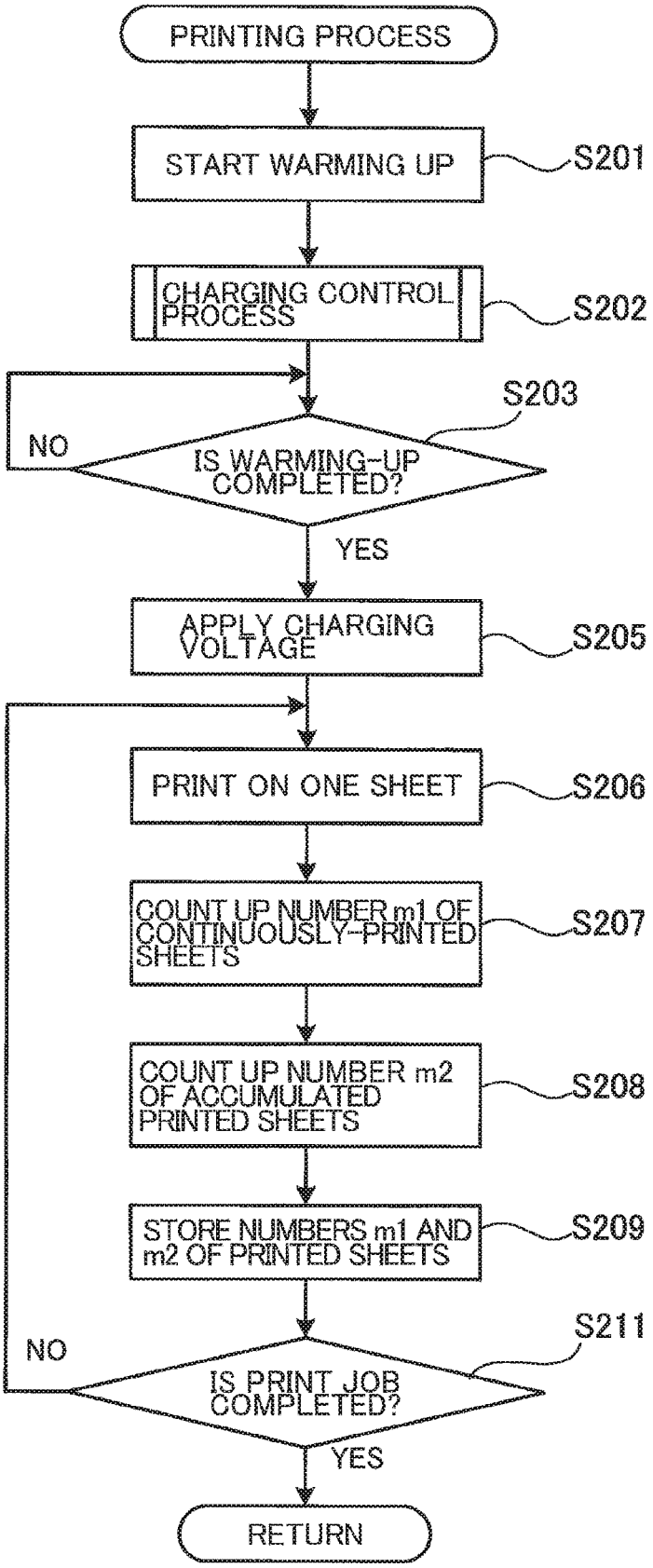
FIG. 6 is a flowchart of a printing process shown in FIG. 5.

Returning to the printing process of FIG. 6, the CPU 31 determines in S203 whether the warming-up operation has completed. It is noted that completion of the warming-up operation is determined based on whether the temperature of the fixing device 8 has reached a prescribed value. When it is determined, that the warming-up operation has not yet completed (S203: NO), the CPU 31 continues executing the warming-up operation. On the other hand, when the warming-up operation is completed (S203: YES), in S205 the CPU 31 applies the charging voltage determined, in the charging control process of S202 to the grid of the charging device 52. Then, the CPU 31 performs printing on one sheet in S206.

Then, in S207 the CPU 31 counts up the number m1 of continuously-printed sheets. That is, the CPU 31 increments the number m1 of continuously-printed sheets by one (1). Next in S208, the CPU 31 counts up the number m2 of accumulated printed sheets. That is, the CPU 31 increments the number m2 of accumulated printed sheets by one (1). Then, in S209 the CPU 31 stores, in the NVRAM 34, the number m1 of continuously-printed sheets counted up in S207 and the number m2 of accumulated printed sheets counted up in S208.

Next, the CPU 31 determines in S211 whether printing requested by the received print job has completed. When printing for the print job has not yet completed (S211: NO), the CPU 31 returns the procedure to S206, and performs printing on another sheet with using the same charging voltage that has been used for a preceding sheet. It is noted that the CPU 31 applies the charging voltage to the charging device 52 only for a necessary period of time that is determined dependently on a printing status or a sheet conveying status. When the print job is completed (S211: YES), the CPU 31 ends the printing process.

Figure 5:
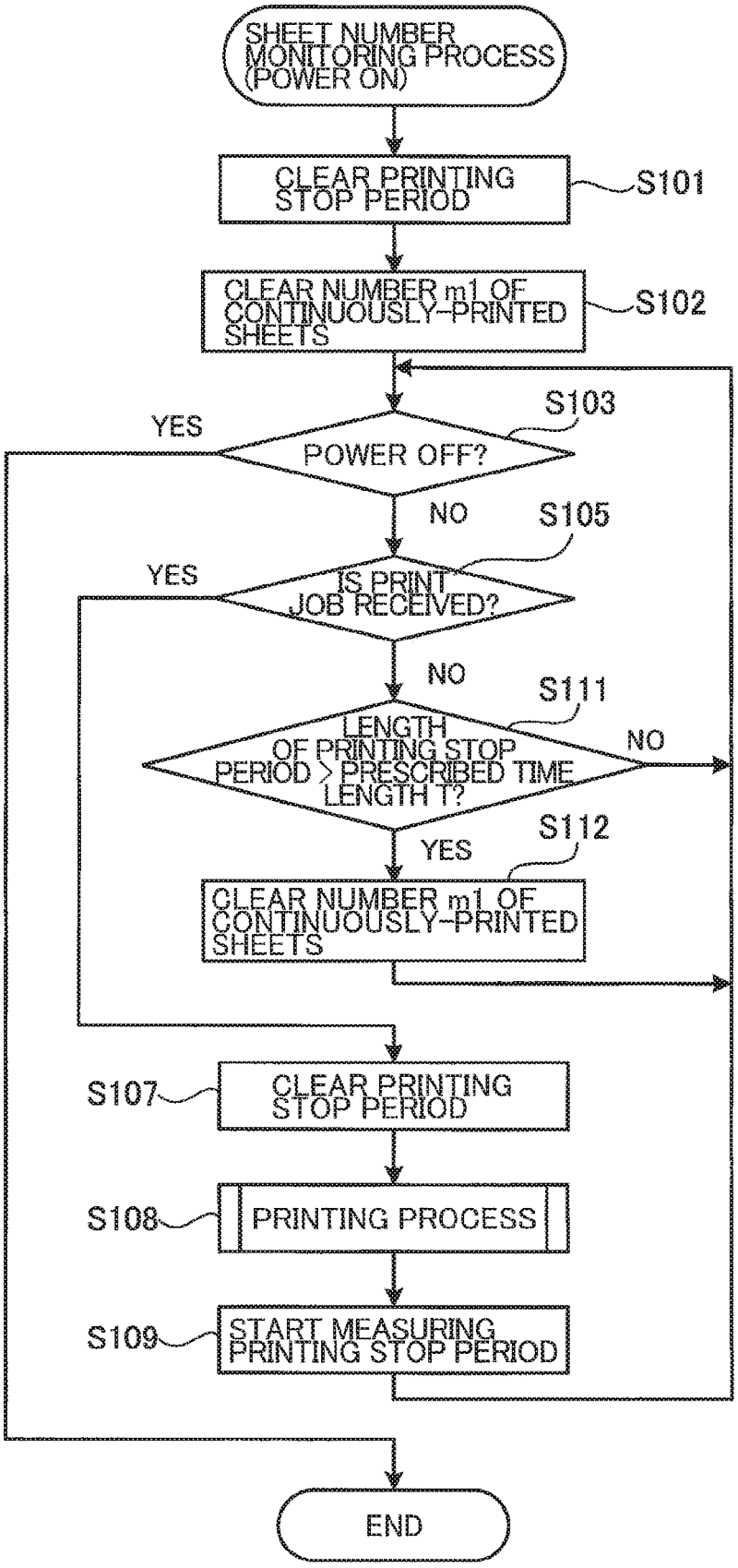
FIG. 5 is a flowchart of a sheet number monitoring process executed in the printer.

Returning to the sheet number monitoring process of FIG. 5, in S109 the CPU 31 controls a counter to start measuring the printing stop period. Then, returning to S103, the CPU 31 determines whether input of a power-off instruction has been received. When a power-off instruction has not been received (S103: NO), the CPU 31 determines in S105 whether a print job has been received. When no print job is received (S105: NO), in S111 the CPU 31 determines, by checking the counter that has started measuring the printing stop period in S109, whether the length of the printing stop period has exceeded the prescribed tune length T.

When the length of the printing stop period has exceeded the prescribed time length T (S111: YES), in S112 the CPU 31 clears the number m1 of continuously-printed sheets to zero (0), and returns the procedure to S103. On the other hand, when the length of the printing stop period has not exceeded the prescribed time length T (S111: NO), the CPU 31 returns the procedure directly to S103.

As described above in detail, the printer 100 of the embodiment counts the number of printed sheets and stores the counted numbers in the NVRAM 34. Then, the amount of the charging voltage is set on the basis of a sum of: the correction value that is determined based on the number m1 of continuously-printed sheets; and the reference charging voltage V1 that is determined based on the target potential of the photosensitive body 51. By adding to the reference charging voltage V1 the correction value that is determined based on the number m1 of continuously-printed sheets, the amount of the charging voltage can be set dependently on the amount of residual charge that is supposed to exist inside the photosensitive body 51. Thus, even if residual charge reaches the surface of the photosensitive body 51 at its portion downstream of the charging range in the photosensitive body rotating direction and decreases the surface potential of the photosensitive body 51, it is ensured that the photosensitive body 51 has a sufficiently high surface potential when the photosensitive body 51 is exposed to light. In other words, even if residual charge reaches the surface of the photosensitive body 51 after the photosensitive body 51 is charged and decreases the surface potential, it is ensured that the photosensitive body 51 has a sufficiently high surface potential at the time when the photosensitive body 51 is exposed to light. Thus, degradation in image quality can be suppressed.

While the description has been made in detail with reference to the specific embodiment thereof, it would be apparent to those skilled in the art that various changes and modifications may be made therein without departing from the spirit and scope of the above described embodiment.

For example, the printer 100 of the embodiment can be modified into any device having an electrophotographic image forming function, such as a copying machine, a scanner, and a facsimile machine. Further, the printer 100 may be modified into a monochrome printer.

It is sufficient that the charging voltage is set based on a sum of the correction value and the reference charging voltage. For example, in the embodiment, the charging voltage is equal to the sum. However, the sum may be further added with other one or more correction value that is determined dependent on one or more other factor, such as the environment and print settings. The numerical values described in the embodiment are merely an example, but may be appropriately chosen dependently on the type of the photosensitive body 51, the type of toner, or the like.

Further, the new product reference charging voltage V0 may be the same for respective colors in the image forming section 5, but may be different for the respective colors. The printed amount is not limited to the number of printed sheets. For example, the printed amount may be data in which a fixed value is added every time one toner image is formed. The added value may not be fixed, but may change dependently on factors such as the environment and the sheet type. In the embodiment, the correction values are calculated by using all of the coefficients k1, k2, and k3.

However, all of these coefficients k1, k2, and k3 may not be used to determine the correction values. For example, a single coefficient may be used as both of the coefficients k1 and k2.

Further, in the embodiment, the printer 100 uses the positively charged toner. However, the printer 100 may be modified to use negatively charged toner. In that case, the charging polarity of the photosensitive body 51 and the polarity of the residual charge are opposite to those of the embodiment. Accordingly, the polarities of the correction values for correcting the charging voltage are reversed from those of the embodiment.

In the embodiment, the power-off period is not acquired. However, the power-off period may be acquired. For example, the printer may store data of the time when the power is turned off. In such a case, the power-off period can be acquired when the power is turned on. In that case, instead of performing the process of S102 in which the number m1 of continuously-printed sheets is always cleared, the CPU 31 may perform a process of determining whether or not to clear the number m1 of continuously-printed sheets dependently on the length of the power-off period. In this case, the CPU 31 clears the number m1 of continuously-printed sheets only when the length of the power-off period indicates that the length of the printing stop period has exceeded the prescribed time length T.

In the embodiment, the number m1 of continuously-printed sheets is reset in S112 when a condition that the length of the printing stop period exceeds the prescribed time length T is satisfied. However, this condition may be combined with other one or more conditions so that the number m1 of continuously-printed sheets may be reset when the combined conditions are satisfied.

Further, in the embodiment, the grid voltage of the charging device 52 is controlled dependently on the amount of the residual charge. However, the wire current may be controlled instead. That is, when it is determined that the amount of residual charge existing in the charging range is relatively large, the amount of the wire current may be increased instead of increasing the grid voltage. Further, the scorotron type charging device 52 may be modified to other types of charging device: such as a corotron type charging device; and a contact charge type charging device that uses a charging roller, a charging brush, or the like.

Further, in the printer 100 of the embodiment, the photosensitive body 51 has a single layer structure, in which the photosensitive body 51 has the single organic photosensitive layer 512 containing both of the charge generating agent 513 and charge transporting agent 514. However, the photosensitive body 51 may be modified into other types of photosensitive body, such as a double layer structure, in which the photosensitive body includes: a transporting layer that contains the charge transporting agent 514, but contains no charge generating agent 513; and a generating layer that contains both of the charge generating agent 513 and charge transporting agent 514, such that the transporting layer and the generating layer are arranged in this order in a direction from the metal core 511 toward radially outward. For example, the photosensitive body 51 may employ a triple layer structure that additionally includes a surface layer.

Further, the cleaner that contacts the photosensitive body 51 to remove toner therefrom is not limited to the blade-shaped cleaner 56. However, in the case where the blade member is used as the cleaner 56, charge tends to be generated in the photosensitive body 51 due to contact by the cleaner 56 and the amount of residual charge existing in the charging range becomes relatively large, in comparison with a case where a roller member or a brush member is used as the cleaner 56. Accordingly, the charging control of the embodiment is particularly effective in a printer employing the blade member as a cleaner.

Further, the charging voltage may be controlled even while a print job is being performed. For example, when the temperature inside the apparatus 100 becomes higher than a prescribed temperature range while a print job is being performed, the charging voltage may be decreased. Or, the charging control process may be performed every time when printing is performed on one sheet, for example.

Further, the processes performed in the embodiment may be executed by a single CPU, a plurality of CPUs, hardware such as ASIC, or any combinations thereof. Further, the processes performed in the embodiment can be realized in various ways such as a method and a non-transitory computer readable storage medium storing a set of program instructions for performing the processes.

The printer 100 in the embodiment is of a direct transfer type, in which a toner image is transferred from the photosensitive body 51 directly onto a sheet conveyed by the conveying belt 7. However, the printer 100 may be modified to an intermediate transfer type, in which a toner image is transferred from the photosensitive body 51 first to the conveying belt 7, and then transferred from the conveying belt 7 onto a sheet.

In the embodiment, the number m1 of continuously-printed sheets is determined and used for determining the correction values. The number m1 of continuously-printed sheets is the total number of sheets, onto which are transferred those toner images that have been formed continuously until the current time. Instead, a total number of rotations that the photosensitive body 51 has attained to form toner images continuously until the current time, can be determined and used for determining the correction values. Or, a total length of charging times, during which the charging device 52 has charged the photosensitive body 51 to form toner images continuously until the current time, can be determined and used for determining the correction values. Or, a total length of exposure times, during which the exposure device 53 has irradiated light onto the photosensitive body 51 to form toner images continuously until the current time, can be determined and used for determining the correction values.

What is claimed is:

1. An image forming apparatus comprising:

an image forming portion configured to form a toner image, the image forming portion comprising:

a photosensitive body;

a charging device configured to charge a surface of the photosensitive body;

an exposure device configured to irradiate light on the surface of the photosensitive body;

a toner supply device configured to supply toner to the photosensitive body; and a transfer device configured to transfer a toner image from the photosensitive body to transfer medium, the image forming portion being configured to perform continuous printings in succession, a plurality of print jobs being executed in succession during each continuous printing, a time interval between every two successive print jobs contained in a single continuous printing being shorter than or equal to a prescribed length; and a control device configured to perform:

determining a continuously printed amount that has been attained during each continuous printing;

determining an accumulated printed amount that has been accumulated from when a new product of the photosensitive body was provided in the image forming portion; and setting a charging voltage to be applied to the charging device during each continuous printing based on a sum of a reference charging voltage and a correction value, the reference charging voltage being determined based on both of: a target surface potential of the photosensitive body, and the accumulated printed amount determined at a time when each continuous printing is started, the reference charging voltage being maintained unchanged during each continuous printing, the correction value being determined based on the continuously printed amount such that the correction value changes in accordance with an increase in the continuously printed amount during each continuous printing.

2. The image forming apparatus according to claim 1, wherein the continuously printed amount is defined by at least one of: a number of transfer medium, onto which the continuously formed toner images have been transferred; a number of rotations by which the photosensitive body has attained to continuously form the toner images; a length of charging time, during which the charging device has charged the photosensitive body to continuously form the toner images; and a length of exposure time, during which the exposure device has irradiated light onto the photosensitive body to continuously form the toner images.

3. The image forming apparatus according to claim 1, wherein the control device is configured such that every time when the control device receives a print job instruction instructing execution of a print job contained in a continuous printing, the control device sets the charging voltage for the print job by setting both of the reference charging voltage and the correction value for the print job, the reference charging voltage for the print job contained in the continuous printing being determined based on the accumulated printed amount that is determined at a time when a print job instruction is received for a first print job that is executed for a first time during the subject continuous printing, the correction value for the print job contained in the continuous printing being determined based on the continuously printed amount that is determined at a time when a print job instruction is received for the print job.

4. The image forming apparatus according to claim 1, wherein the image forming portion includes a cleaning member configured to contact the photosensitive body to remove toner from the photosensitive body.

5. The image forming apparatus according to claim 4, wherein the transfer device is configured to transfer toner from the photosensitive body directly to the transfer medium, the cleaning member includes a blade that is disposed at a position downstream of the transfer device and upstream of the charging device in a rotating direction of the photosensitive body, the blade being configured to contact the photosensitive body in a counter direction relative to a rotating direction of the photosensitive body.

6. The image forming apparatus according to claim 1, wherein the control device is configured to set, as the reference charging voltage, a sum of a prescribed charging voltage that is applied to the charging device when the accumulated printed amount is equal to zero and a reference-voltage adjusting value whose absolute value increases as the accumulated printed amount determined at a time when a continuous printing is started increases.

7. An image forming apparatus comprising:

an image forming portion configured to form a toner image, the image forming portion comprising: a photosensitive body; a charging device configured to charge a surface of the photosensitive body; an exposure device configured to irradiate light on the surface of the photosensitive body; a toner supply device configured to supply toner to the photosensitive body; and a transfer device configured to transfer a toner image from the photosensitive body to transfer medium;

an electric power supply configured to supply electric power to the image forming portion; and a control device configured to perform:

determining a continuously printed amount that has been attained by the image forming portion while the image forming portion has formed toner images continuously with a time interval between every two successive image-forming timings having a length shorter than or equal to a prescribed length, the image forming portion forming a toner image at each image-forming timing; and setting a charging voltage to be applied to the charging device based on a sum of a reference charging voltage and a correction value, the reference charging voltage being determined based on a target surface potential of the photosensitive body, the correction value being determined based on the continuously printed amount, wherein the control device is configured to reset the continuously printed amount to zero (0) in response to at least one of a first event, in which the electric power supply is turned off, and a second event, in which a length of a non-exposure time exceeds the prescribed length, the non-exposure time being a continuous period of time, during which the exposure device performs no irradiation of light onto the photosensitive body, and wherein when the continuously printed amount is smaller than a prescribed amount, the control device determines the correction value by using a value that is obtained by multiplying the continuously printed amount by a first correction coefficient, when the continuously printed amount is greater than the prescribed amount, the control device determines the correction value by using a value that is obtained by multiplying a difference between the continuously printed amount and the prescribed amount by a second correction coefficient, and an absolute value of the second correction coefficient is smaller than an absolute value of the first correction coefficient.

8. The image forming apparatus according to claim 7, wherein an absolute value of the first correction coefficient that the control device uses to set the charging voltage after resetting the continuously printed amount, is greater than an absolute value of the first correction coefficient that the control device has used to set the charging voltage before resetting the continuously printed amount.

9. The image forming apparatus according to claim 7, wherein an absolute value of the second correction coefficient that the control device uses to set the charging voltage after resetting the continuously printed amount, is greater than an absolute value of the second correction coefficient that the control device has used to set the charging voltage before resetting the continuously printed amount.

10. An image forming apparatus comprising:

an image forming portion configured to form a toner image, the image forming portion comprising: a photosensitive body; a charging device configured to charge a surface of the photosensitive body; an exposure device configured to irradiate light on the surface of the photosensitive body; a toner supply device configured to supply toner to the photosensitive body; and a transfer device configured to transfer a toner image from the photosensitive body to transfer medium; and a control device configured to perform:

determining a continuously printed amount that has been attained by the image forming portion while the image forming portion has formed toner images continuously with a time interval between every two successive image-forming timings having a length shorter than or equal to a prescribed length, the image forming portion forming a toner image at each image-forming timing; and setting a charging voltage to be applied to the charging device based on a sum of a reference charging voltage and a correction value, the reference charging voltage being determined based on a target surface potential of the photosensitive body, the correction value being determined based on the continuously printed amount, wherein the control device is configured to determine an accumulated printed amount, the accumulated printed amount being a printed amount that has been accumulated from when a new product of the photosensitive body was provided in the image forming portion and until a current timing, set the reference charging voltage such that an absolute value of the reference charging voltage increases as the accumulated printed amount increases, and set, as the reference charging voltage, a sum of a prescribed charging voltage that is applied to the charging device when the accumulated printed amount is equal to zero and a reference-voltage adjusting value whose absolute value increases as the accumulated printed amount increases.

11. An image forming method for an image forming apparatus, the image forming apparatus comprising: an image forming portion configured to form a toner image, the image forming portion comprising: a photosensitive body; a charging device configured to charge a surface of the photosensitive body; an exposure device configured to irradiate light on the surface of the photosensitive body; a toner supply device configured to supply toner to the photosensitive body; and a transfer device configured to transfer a toner image from the photosensitive body to transfer medium, the image forming portion being configured to perform continuous printings in succession, a plurality of print jobs being executed in succession during each continuous printing, a time interval between every two successive print jobs contained in a single continuous printing being shorter than or equal to a prescribed length, the image forming method comprising:

determining a continuously printed amount that has been attained during each continuous printing;

determining an accumulated printed amount that has been accumulated from when a new product of the photosensitive body was provided in the image forming portion; and setting a charging voltage to be applied to the charging device during each continuous printing based on a sum of a reference charging voltage and a correction value, the reference charging voltage being determined based on both of: a target surface potential of the photosensitive body; and the accumulated printed amount determined at a time when each continuous printing is started, the reference charging voltage being maintained unchanged during each continuous printing, the correction value being determined based on the continuously printed amount such that the correction value changes in accordance with an increase in the continuously printed amount during each continuous printing.

12. The image forming method according to claim 11, wherein the continuously printed amount is defined by at least one of: a number of transfer medium, onto which the continuously formed toner images have been transferred; a number of rotations by which the photosensitive body has attained to continuously form the toner images; a length of charging time, during which the charging device has charged the photosensitive body to continuously form the toner images; and a length of exposure time, during which the exposure device has irradiated light onto the photosensitive body to continuously form the toner images.

13. A non-transitory computer readable storage medium storing a set of program instructions for an image forming apparatus, the image forming apparatus comprising: an image forming portion configured to form a toner image, the image forming portion comprising: a photosensitive body; a charging device configured to charge a surface of the photosensitive body; an exposure device configured to irradiate light on the surface of the photosensitive body; a toner supply device configured to supply toner to the photosensitive body; and a transfer device configured to transfer a toner image from the photosensitive body to transfer medium, the image forming portion being configured to perform continuous printings in succession, a plurality of print jobs being executed in succession during each continuous printing, a time interval between every two successive print jobs contained in a single continuous printing being shorter than or equal to a prescribed length, the program instructions, when executed by the image forming apparatus, causing the image forming apparatus to perform:

determining a continuously printed amount that has been attained during each continuous printing;

determining an accumulated printed amount that has been accumulated from when a new product of the photosensitive body was provided in the image forming portion; and setting a charging voltage to be applied to the charging device during each continuous printing based on a sum of a reference charging voltage and a correction value, the reference charging voltage being determined based on both of: a target surface potential of the photosensitive body; and the accumulated printed amount determined at a time when each continuous printing is started, the reference charging voltage being maintained unchanged during each continuous printing, the correction value being determined based on the continuously printed amount such that the correction value changes in accordance with an increase in the continuously printed amount during each continuous printing.

14. The non-transitory computer readable storage medium according to claim 13, wherein the continuously printed amount is defined by at least one of: a number of transfer medium, onto which the continuously formed toner images have been transferred; a number of rotations by which the photosensitive body has attained to continuously form the toner images; a length of charging time, during which the charging device has charged the photosensitive body to continuously form the toner images; and a length of exposure time, during which the exposure device has irradiated light onto the photosensitive body to continuously form the toner images.

* * * * *